United States Patent [19]

Tennant

[11] 4,181,221

[45] Jan. 1, 1980

[54] PORTABLE GUN DISPLAY

[76] Inventor: Walter Tennant, P.O. Box 810, Livingston, Mont. 59047

[21] Appl. No.: 954,938

[22] Filed: Oct. 26, 1978

[51] Int. Cl.[2] ..... B65D 85/00; A47B 81/00

[52] U.S. Cl. ..... 206/317; 211/64; 211/195

[58] Field of Search ..... 206/317; 211/64, 62, 211/68, 189, 195, 196

[56] References Cited

U.S. PATENT DOCUMENTS

| | | | |
|---|---|---|---|
| 2,158,623 | 5/1939 | Feschbacher | 206/317 |
| 2,251,271 | 8/1941 | Del Campo | 211/62 |
| 2,541,722 | 2/1951 | Shachelford | 211/195 |
| 2,593,402 | 4/1952 | Aitchison | 211/64 |

*Primary Examiner*—Herbert F. Ross

[57] ABSTRACT

A portable gun display including a base, supports extending upwardly from the base, a cross member connecting the upper portions of the supports, the base including two box sections each having side and end panels, a top panel joining the side and end panels, and an open bottom, the box sections being disposed next to each other with a side panel of one adjoining and parallel to a side panel of the other, hinge means connecting at least a portion of the edges of the adjoining side panels which are remote from the top panels, the top panels having support-receiving means disposed adjacent and inside the end panels, spaced gun butt-receiving slots in each of the top panels, the slots having a tapered bottom section, the supports being of a length less than the distance between the end panels of each box section and having cross member-receiving means adjacent the upper portions thereof, the cross member being of a length less than the distance between the end panels of each box section and including means for connection thereof to the upper portions of the supports, and a plurality of spaced recesses along at least one substantially vertical surface thereof, whereby the cross member can be separated from the supports, the supports separated from the box sections, the hinge connected box sections inverted, the cross member and the supports positioned within the box sections and the open faces of the box sections closed on each other to form a unitary assembly.

9 Claims, 5 Drawing Figures

PORTABLE GUN DISPLAY

This invention relates to a novel gun display and more particularly relates to a new portable apparatus for displaying guns.

The display of guns at shows such as sportman's shows, gun exhibitions and the like generally involves the laying of a row of guns on a cloth covered table. While such a display is simple to set up, the guns cannot be examined closely unless the guns are picked up from the table. However, when the guns are replaced on the table, they may not be returned to their original position so that after only a few minutes, the display looks unkempt and in need of rearrangement. Also, if the guns are of special value, the handling of the guns may not be desired.

A variety of gun display stands have been proposed, but none have gained significant acceptance. Some of the stands are quite large and difficult to transport. Others can be broken down to reduce their size for transfer, but taking the stands apart is time consuming and requires one or more tools. A further problem is keeping all of the parts together until they are to be reassembled. If a great deal of care is not exercised to do this, one or more of the parts and particularly the fastening elements, probably will be lost. This requires scurrying around to locate replacements or else the foresight to maintain an inventory of replacement parts. Neither is a desirable solution because of the loss of time and money involved.

The present invention provides a novel gun display which positions the guns in a unique arrangement. The gun display of the invention simplifies inspection of the working parts of the guns. The gun display also facilitates proper alignment of the guns automatically. In addition, the gun display of the invention can be assembled quickly and easily without special skills or tools. Further, the gun display may be broken down into components that can be transported in a single container. Moreover, the gun display is simple in design and can be fabricated from commerically available materials utilizing conventional fabricating techniques.

Other benefits and advantages of the novel gun display of the present invention will be apparent from the following description and the accompanying drawings in which.

Figure 1:
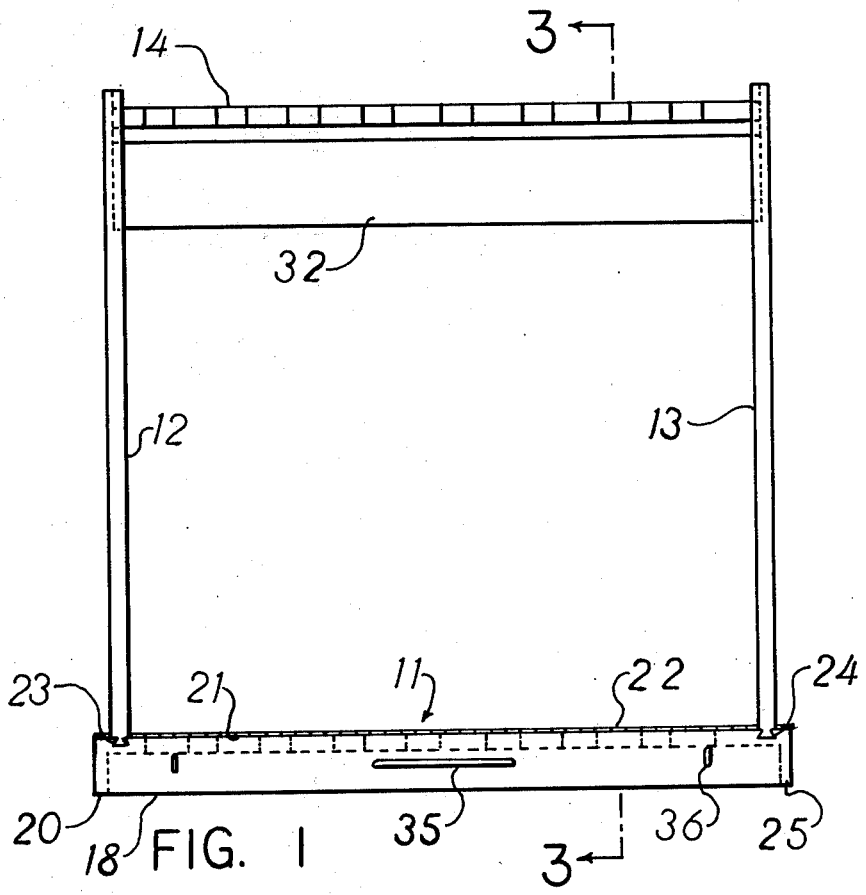
FIG. 1 is a side elevation of one form of the gun display of the invention.

As shown in the drawings, one form of the novel gun display of the invention includes a base 11, supports 12 and 13 extending upwardly from the base and a cross member 14 connecting the upper portions of the supports.

Base 11 includes two box sections 16 and 17. Each box section includes side panels 18 and 19 and end panels 20. Top panel 21 joins the side and end panels. The panels 18, 19, 20 and 21 form a box section with an open bottom. The box sections 16 and 17 are disposed next to each other when the display is assembled with a side panel 19 of one box section adjoining and parallel to a corresponding panel 19 of the other box section. Hinge means connect at least a portion of the edges of the adjoining side panels 19 which are remote from the top panels 21. As shown, the hinge may be a continuous hinge 22 or alternatively may be several short hinge sections spaced along the adjoining edges.

Figure 2:
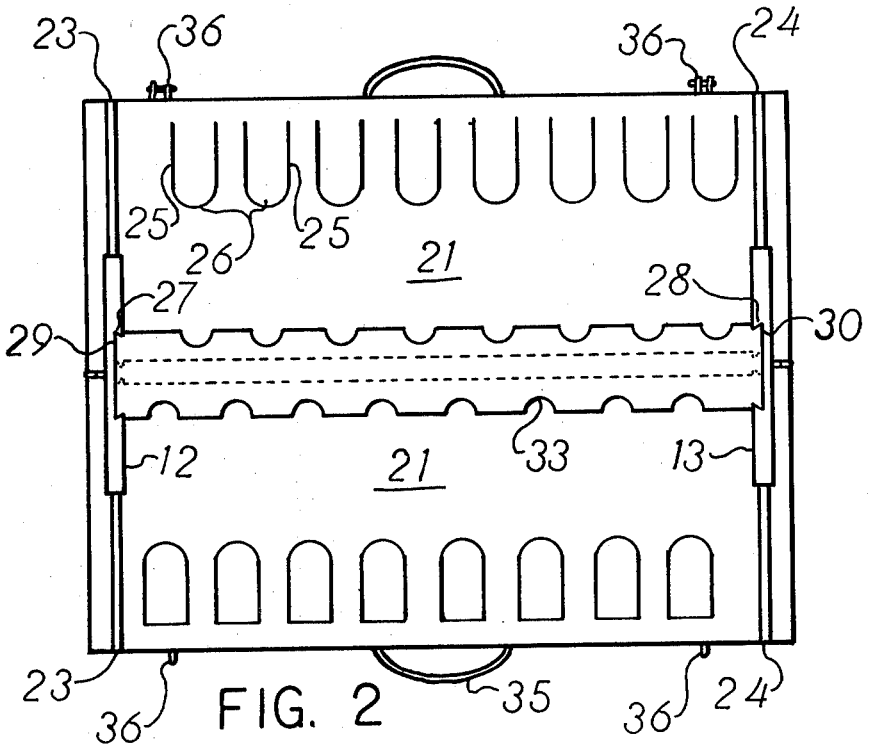
FIG. 2 is a top view of the gun display of the invention shown in FIG. 1.
Figure 3:
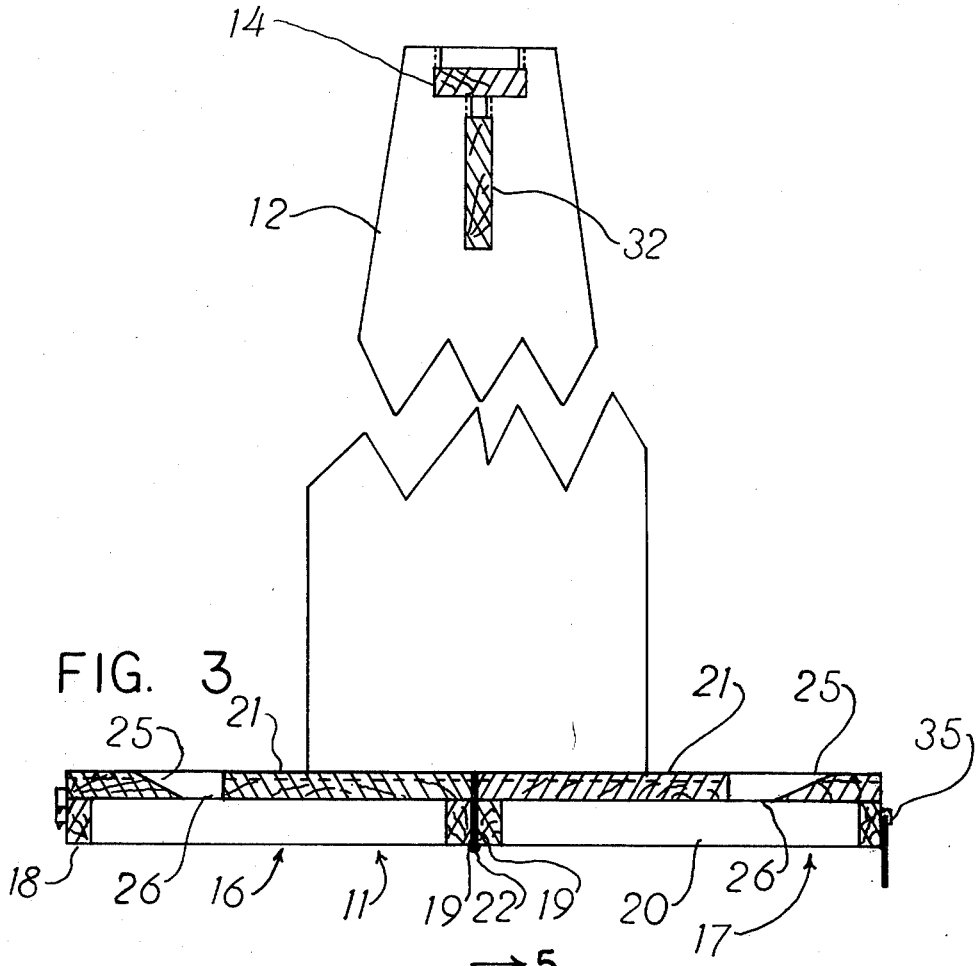
FIG. 3 is a sectional view of the gun display shown in FIG. 1 taken along line 3—3.
Figure 4:
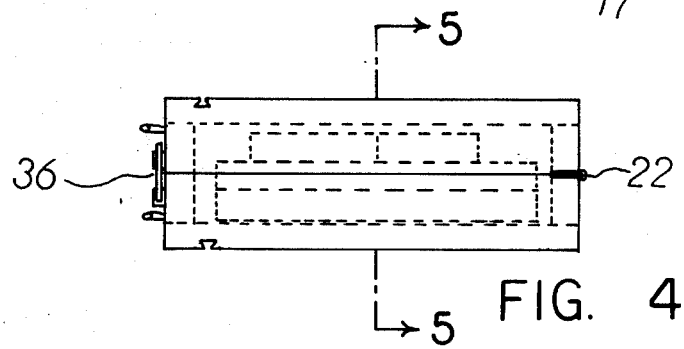
FIG. 4 is an end view of the gun display shown in FIG. 1 broken down with the components combined for transfer.
Figure 5:
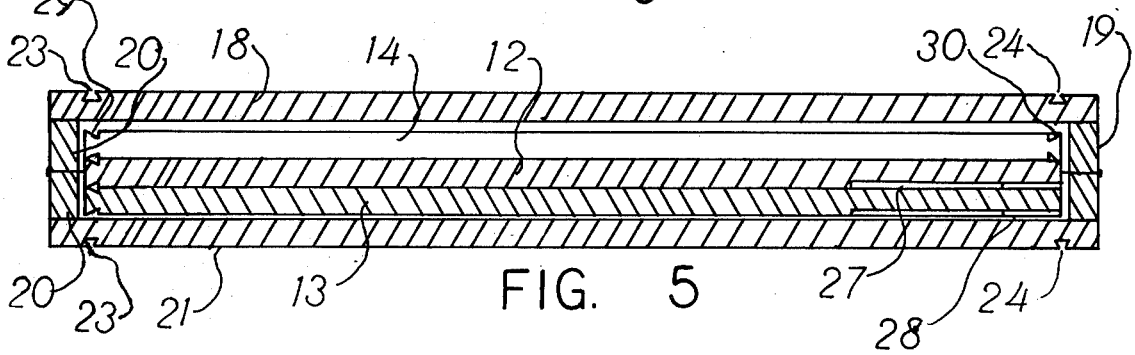
FIG. 5 is a sectional view of the gun display shown in FIG. 4 taken along line 5—5.

The top panels 21 have support-receiving means disposed adjacent and inside the end panels 20. In the drawings, the support-receiving means are recessed dovetail tracks 23 and 24. Top panels 21 also include a plurality of gun butt slots 25. Gun butt slots 25 are spaced transverse slots located in at least one of the top panels 21 and preferably in both of the top panels. The slots 25 have tapered bottom sections as shown in FIG. 2 with the ends 26 thereof closest to the hinge 22 advantageously extending completely through the top panels.

The supports 12 and 13 are of a length less than the distance between the end panels 20 of each box section. Each support 12 or 13 has cross member receiving means adjacent the upper portions thereof. Preferably, the cross member receiving means is a dovetail slot 27 or 28 as in the drawings. The configuration of the supports 12 and 13 may be tapered, straight or a fancy design as desired.

Cross member 14 also is of a length less than the distance between the end panels 20 of each box section. Further, cross member 14 includes means for connection thereof to the upper portions of the supports 12 and 13. As shown, dovetail extensions 29 and 30 in the ends of the cross member 14 connect the cross member with the supports. Advantageously, a second vertically disposed cross member 32 connects the supports 16 and 17 in a manner similar to the connections between cross member 14 and the supports. Cross member 32 adds additional stiffening to the display when it is assembled and in use.

Recesses 33 are spaced along at least one substantially vertical surface of the cross member 14 and preferably along both sides thereof. The recesses advantageously are generally semicircular in configuration with a recess disposed in a vertical plane above each of the gun butt slots 25.

The novel gun display of the present invention as shown in the drawings is assembled by first setting up the base 11. This is accomplished by arranging box sections 16 and 17 so that their open faces lie in a single plane with side panels 19 adjacent to each other. In this orientation, the base 11 can be placed on a supporting surface such as a table with the open faces in contact with the table top. The dovetail tracks 23 and 24 are exposed and in position to receive the lower ends of supports 12 and 13.

Next, the dovetailed lower ends of supports 12 and 13 are slid into tracks 23 and 24 and cross member 32 slid into position to connect the two supports. Then cross member 14 is added on top to complete the structure.

Guns are displayed on the apparatus of the invention with their magazines extending outwardly and their butt ends each in one of the slots 25. Since the slots have tapered bottom surfaces in which the deepest part is closest to the hinged area of the top panels 21, the gun barrel will be inclined toward the corresponding recess 33 in the cross member 14 at the top of the display stand and bear against it.

Inspection of the guns on the display of the invention is convenient because the working parts of the gun are clearly visible. Also, inspection is facilitated because the working parts are at a level well above the table top and closer to the eye. If a gun is removed from the display and inspected and handled, it can be returned to its original position without requiring significant attention to its placement. This is because the display has a separate holder for each gun, that is, a recess 33 for the gun barrel and a slot 25 for the butt of the gun.

When it is desired to terminate the showing of the guns, the guns are removed from the display and the cross members 14 and 32 separated from the supports 12 and 13. The supports next are separated from the base 11 by sliding the supports from the tracks 23 and 24. Thereafter, the base 11 is turned over so that the open faces are visible. Then the supports 12 and 13 are placed in one of the box sections 16 or 17 and the cross members 14 and 32 also.

When all of the components have been placed into one of the box sections 16 or 17, the other box section is pivoted on top of the first box section. Latches 36 are closed to secure the box sections to each other. The assembly then is ready for carrying by handle or handles 35 which extend form side panels 18 adjacent to the latches 36. Since all of the components are sealed within the container formed by the two box sections, reassembly when desired can be accomplished simply without concern that parts may be missing.

The above description and the accompanying drawings show that the present invention provides a novel gun display which simplifies the inspection of the guns. Also, the gun display of the invention minimizes the need for picking up of the guns. Further, the gun display positions the guns for convenient inspection of the working parts. In addition, proper alignment of the guns on the display is achieved automatically without requiring attention to the placement.

The novel gun display of the invention can be assembled quickly and easily without special skills and tools. Also, the gun display may be broken down into its components so that it can be transported and stored conveniently in a single container without concern that any of the parts will be lost. The gun display of the invention is simple in design and can be fabricated from commercially available materials employing conventional manufacturing techniques.

It will be apparent that various modifications can be made in the particular gun display described above and shown in the drawings within the scope of the invention. For example, the size and configuration of the components of the display can be changed to meet specific requirements. Also, the shape and number of the recesses and slots can be different for particular gun designs. Therefore, the scope of the invention is to be limited only by the following claims.

What is claimed is:

1. A portable gun display including a base, supports extending upwardly from said base, a cross member connecting the upper portions of said supports, said base including two box sections each having side and end panels, a top panel joining said side and end panels, and an open bottom, said box sections being disposed next to each other with a side panel of one adjoining and parallel to a side panel of the other, hinge means connecting at least a portion of the edges of the adjoining side panels which are remote from said top panels, said top panels having support-receiving means disposed adjacent and inside said end panels, spaced gun butt-receiving slots in at least one of the top panels, said slots having a tapered bottom section, said supports being of a length less than the distance between said end panels of each box section and having cross member-receiving means adjacent the upper portions thereof, said cross member being of a length less than the distance between said end panels of each box section and including means for connection thereof to the upper portions of the supports, and a plurality of spaced recesses along at least one substantially vertical surface thereof, whereby the cross member can be separated from said supports, said supports separated from said box sections, said hinge connected box sections inverted, said cross member and said supports positioned within said box sections and the open faces of said box sections closed on each other to form a unitary assembly.

2. A gun display according to claim 1 wherein said gun butt-receiving slots have tapered sections with the ends thereof closest to said hinge extending through said top panel.

3. A gun display according to claim 1 wherein said recesses are disposed on both vertical surfaces of said cross member and said gun butt-receiving slots are disposed in both top panels.

4. A gun display according to claim 1 wherein said cross member and said supports are of a length only slightly less than the distance between said end panels of each box section.

5. A gun display according to claim 1 wherein said support-receiving means of said box sections include recessed tracks.

6. A gun display according to claim 1 wherein said cross member-receiving means of said supports include dovetail recesses.

7. A gun display according to claim 1 including a second cross member disposed vertically.

8. A gun display according to claim 1 including latch means connecting said box sections.

9. A gun display according to claim 1 including handle means on at least one of said box sections.

* * * * *